United States Patent [19]

LaBelle et al.

[11] Patent Number: 4,988,612

[45] Date of Patent: Jan. 29, 1991

[54] RESISTIVELY HEATABLE PHOTOTHERMOGRAPHIC ELEMENT

[75] Inventors: Gary E. LaBelle, Hugo, Minn.; David T. Ask, Somerset, Wis.

[73] Assignee: Minnesota Mining and Manufacturing Company, St. Paul, Minn.

[21] Appl. No.: 183,257

[22] Filed: Apr. 8, 1988

Related U.S. Application Data

[63] Continuation of Ser. No. 936,248, Dec. 1, 1986, abandoned.

[51] Int. Cl.[5] ..... G03C 1/76

[52] U.S. Cl. ..... 430/531; 430/527

[58] Field of Search ..... 430/531, 527

[56] References Cited

U.S. PATENT DOCUMENTS

| | | | |
|---|---|---|---|
| 3,492,122 | 1/1970 | Takenaka et al. | 430/531 |
| 3,514,291 | 5/1970 | Vanpoecke et al. | 430/531 |
| 3,658,573 | 4/1972 | Guestaux et al. | 117/761 |
| 4,409,316 | 10/1983 | Zller-Pendry et al. | 430/263 |
| 4,409,322 | 10/1983 | Ezaki et al. | 430/531 |
| 4,582,784 | 4/1986 | Fukugawa et al. | 430/531 |
| 4,582,784 | 4/1986 | Fukugawa et al. | 430/531 |
| 4,643,964 | 2/1987 | Sawada et al. | 430/523 |
| 4,643,969 | 2/1987 | Sawada et al. | 430/523 |

*Primary Examiner*—Jack P. Brammer

*Attorney, Agent, or Firm*—Donald M. Sell; Walter N. Kirn; Mark A. Litman

[57] ABSTRACT

The use of polymers and polymer blends having defined resistance changes during heating are particularly useful in resistively heated photothermographic elements.

14 Claims, No Drawings

RESISTIVELY HEATABLE PHOTOTHERMOGRAPHIC ELEMENT

This is a continuation of application Ser. No. 936,248 filed Dec. 1, 1986, now abandoned.

TECHNICAL FIELD

The present invention relates to photothermographic imaging materials and in particular to such imaging materials which may be heated for development of images by the application of voltage across an electrically resistive layer.

BACKGROUND OF THE ART

Photothermographic imaging systems are those imaging materials which, upon first being exposed to light in an imagewise fashion, produce an image when subsequently heated. The exposure to light or other radiation photo-activates or photodeactivates a component in the imageable element and subsequent heating causes an image forming reaction to differentially occur in exposed and unexposed regions.

A variety of different types of photothermographic technologies exist in the marketplace. Thermal diazonium systems such as those disclosed in U.S. Pat. Nos. 4,230,789; 4,168,171 and 3,754,916 comprise an acid-stabilized light-sensitive diazonium salt, a compound that couples with diazonium salts (known as an azo-coupling compound), and a neutralizing compound which becomes basic, release base by decomposition, or is basic and migrates to the acid-stabilized diazonium salt upon being heated. These components are in a binder system coated onto a support base.

Another well known photothermographic imaging system is described in U.S. Pat. Nos. 3,457,075; 3,839,049; 4,460,861 and 3,994,732. These imageable systems comprise a silver source material (usually an organic silver salt, a silver salt of an organic long chain fatty carboxylic acid, or a complexed silver salt), silver halide in catalytic proximity to the silver source material, a reducing agent for silver ion, and a binder.

Other photothermographic imaging systems comprising leuco dye oxidation systems and dye-bleach systems such as those described in U.S. Pat. Nos. 4,336,323; 4,373,020; and 4,515,885 are also useful systems.

Each of these systems are used either by first exposing the element to light and then having the entire element heated (e.g., on a heated drum roll, in an inert oil bath, or by exposure to infrared radiation) or by heating and exposing the element contemporaneously. All of these forms of heating tend to be energy inefficient and may cause unequal development of the image because of unequal heating. To overcome some of these difficulties, a few recent products having opaque support layers have been provided with a conductive layer such as vapor deposited metal or carbon black-filled polymeric resin. This conductive layer, or more accurately resistive layer, allows the element to be heated by the application of a voltage across the layer. The voltage must be sufficient to generate heat in the resistive layer. The heat generated can then be sufficient to thermally develop an image on an exposed photothermographic element. To be used with a transparent substrate, particularly when the final image is to be projected, the resistive layer is often removable.

SUMMARY OF THE INVENTION

A photothermographic element is made capable of being heated for development after imagewise exposure to radiation by placing a resistive layer having resistivity of between 60 and 2000 ohms/square (preferably 60 to 1000) on the back side of the element, said layer having a resistance ratio of at least 1.75 and less than 3.00. The layer must be removable if used with transparent elements, removed as an integral layer by peeling the resistive layer off the photothermographic element or dissolving it.

DETAILED DESCRIPTION OF THE INVENTION

A photothermographically imageable layer or layers is adhered to one side of a support base and a resistive layer having a resistance of between 60 and 2000 ohms per square is adhered to the other side (hereafter the backside) of the support base. When voltage is applied across the resistive layer (e.g., between 70 and 2000 volts), sufficient heat can be produced to develop images in the photothermographic portion of the construction. The photothermographic portion of the construction can be any imageable layer or layers which is photosensitive and developable by being heated in the temperature range of 150° to 350° F. (approximately 65° to 180° C., preferably 80° to 170° C.). The most common photothermographic systems of this type are (1) silver halide photothermographic systems comprising silver halide, a silver source material, and a reducing agent for silver ion in a binder, (2) thermal diazonium photothermographic systems comprising an acid-stabilized diazonium salt, an azo-coupling compound and a base or base-generating material in a binder, (3) dye-bleach photothermographic systems comprising a photosensitive bleach-producing or bleach-removing material and a dye in a binder, and (4) leuco dye oxidation photothermographic systems comprising a leuco dye oxidizable to a colored state, a photosensitive material which generates an oxidizing agent or a photosensitive oxidizing agent that decomposes when light struck. Other systems such as photosensitive materials which color upon a photoinitiated change in pH or photoinitiated coupling are also known and included in the term photothermographic systems. These systems may be in a single layer or in a plurality of layers as is well known in the art. Most preferred are the silver halide photothermographic systems. The construction of the present invention is also particularly useful with add-on silver halide photothermographic systems which must be heated in order to provide light-sensitivity.

The support base or substrate may be any solid material, such as fibrous material, paper, polymeric film, polymer coated paper, and the like. It is preferred that the support base be a polymeric film or paper and most preferred that it be a coated paper with high reflectance.

It has been noted that the resistance of the resistive coating changes with time under applied voltage. It is more accurately noted that the resistance changes with temperature. As the temperature increases in the resistive layer during development, the resistance also increases, reaching an asymtotic peak. This is not an unusual phenomena in itself, but this and discovered properties of binders has provided a useful means of measuring and controlling resistive development.

To better understand the properties and objects of the invention, a standard resistive formulation and resistive heating procedure will be defined so that a focal point for comparison will be provided.

The term "resistance ratio" ($\delta_r$) means the ratio of the resistance of an article ($\delta_f$) after 10 seconds of applied 525 volts divided by the initial resistance ($\delta_i$) of that article at 20° C. after 0 seconds of applied 525 volts. That is, $$\delta_r = \delta_f / \delta_i$$

Measurements for all polymers are made with 40% by weight of furnace made carbon black, with a 1.0 mil ($2.5 \times 10^{-5}$m) thick film using 525 volts.

It has been found in the practice of the present invention that the resistive layer is to have a resistance ratio of greater than 1.50 and preferably greater than 1.75 and less than 3.00. This resistance ratio should be reasonably constant over the dimensions of the resistive layer and should not vary by more than 10% across 1 $cm^2$ areas. It is preferred that these properties be provided with a blend of polymers, one polymer having a resistance ratio of less than 1.75 and the other polymer having a resistance ratio of greater than 2.5. The preferred polymer having a resistance ratio in excess of 2.5 is ethyl cellulose of higher molecular weights (e.g., N-10 ethyl cellulose from Hercules Co.). The preferred polymer having a resistance less than 1.75 is ethyl cellulose of lower molecular weights (e.g., T-10 ethyl cellulose from Hercules Co.). These ethyl cellulose resins are also distinguished by their degree of ethoxylation. The higher resistance ratio polymers (e.g., K-10 and N-10) have ranges of ethoxy contents from 46.1–47.2% and 48.0–49.5% while the lower resistance ratio polymers have higher ethoxy contents in excess of 49.6%. The ethyl cellulose polymers could preferably therefore have ethoxy contents of 49.5% or less to have higher resistance ratios and ethoxy contents of 49.6% or more to have lower resistance ratios. Other lower resistance ratio polymers which are useful include poly(vinylidene chloride), polyurethanes, cellulose acetate, cellulose acetate esters, poly(vinyl acetate), poly(vinyl butyral), poly(vinyl chloride), poly(acrylates), and copolymers of these materials (e.g., poly[vinyl acetate/vinyl chloride/vinyl alcohol], 76/20/4).

It is preferred that the blend of low and high resistance ratio polymers form a compatible dispersion, or solution. It is desirable that the mix of polymers be compatible that if there are any distinct phases of polymers in the film that the phases do not vary by more than 100% from the average size of the phase units. This tends to give the film a milky look, and as indicative of a non-uniform distribution of polymer and a potential variation in localized resistance ratios. IF there are extreme localized variations in the resistance ratio, thermal development will progress at different rates over the photothermographic element. This can create localized image defects and deficiencies.

One of the benefits of having a resistive heating layer with a resistance ratio of between 1.75 and 3.00 is that the rate of resistance change in such layers tends to be much more amenable to sensing by mechanical means. The rate of change tends to be neither as rapid nor so slow that mechanical means cannot utilize the recognition of that change for useful purposes. In mechanical thermal developing apparatus, for example, there is a greater likelihood of allowing for proper development time when working with such intermediate value resistance ratio materials. Once a temperature (or resistance) is sensed by the thermal developing apparatus, the time of development can be more precisely determined if the resistive ratio is within the defined fixed parameters. This enables more consistent and improved development.

Other fillers besides carbon black may be used to load the polymers to create the resistive layer. For example, fillers such as carbon black, graphite, metal, conductive polymers (e.g., polymers having quaternary ammonium groups thereon) and other generally available materials may be used. The binder or resin of the resistive layer may be any material which provides the physical properties necessary. Such resins as polyesters, polyamides, polyolefins, polyvinyls, polyethers, polycarbonates, gelatin, cellulose esters, polyvinyl acetals and the like are all useful.

The resistive layer generally contains from 30 to 60% by weight loading with the filler. Preferably the filler is carbon black or graphite. The resistive film is ordinarily 0.3 to 4 mils thick (0.75 to $10 \times 10^{-5}$m).

The resistive layer may be strippably bonded to the backside of the support base. This can be readily accomplished by a variety of means. For example, the resistive layer may be coated out of solution on to the support base with appropriate resins having been selected for the base and the resistive layer which have only a limited natural affinity for each other. To that end, combinations of polyethyleneterephthalate and cellulose esters, polyesters and polyamides, and polyamides and polyvinyl acetals would provide only limited strength bonding between layers so that the resistive layer could be stripped form the backside of the support base.

An intermediate layer could also be used which is readily strippable from the support base. If the resistive layer is sufficiently thick and strong so as to provide structural integrity, a pressure-sensitive adhesive layer could be used to strippably adhere the resistive layer to the backside of the support base. The resistive layer could be adhered to one side of a carrier layer which is adhered to the backside of the support base. The resistive layer could be adhered to one side of a carrier layer which is adhered to the backside of the support base. In fact, a conductive pressure-sensitive adhesive carried on a support film could be used as the resistive layer.

When the terms "strippably adhered" or "strippably bonded" are used, it is meant and sell understood in the art that the layers are sufficiently well adhered to each other to undergo mild handling without the layers completely separating and yet be separable from each other by hand when required. This generally means that a force of about 0.5 to 9 ounces per inch width (36 to 650 g/cm width) of film is needed to separate the two layers when one film is pulled at 180° from the other at about ninety (90) inches (229 cm) per minute. Preferably this peel force is in the range of 1 to 6 ounces per inch width (72 to 433 g/cm width).

The resistive layer and/or the intermediate layer providing the strippable properties can also provide another function to the element. One problem often encountered with imaging materials is the phenomenon of halation caused by reflection of radiation off the backside of the support layer. If the strippable layer or resistive layer absorbs radiation to which the photothermographic material is sensitive, those layers can act as antihalation layers. Carbon black, in particular, is a good filler for providing panchromatic antihalation properties to the element. Dyes and pigments which absorb within specific regions of the electromagnetic spectrum can also be used. The antihalation property is not essential but is desirable. Thus the resistive layer and/or strippable layer can be transparent, translucent, or opaque. A white background (e.g., by using titania or zinc oxide as a filler) can even be provided.

Even though the construction of the present invention can be heated by application of a voltage across the resistive layer, the exposed element can still be developed by any other form of heating.

Photothermographic dry silver emulsions are usually constructed as one or two layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and the other ingredients in the second layer or both layers.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexed of organic or inorganic silver salts wherein the ligand has a gross stability constant between 4.0 and 10.0 are also desirable. The silver source material should constitute from about 20 to 70 percent by weight of the imaging layer. Preferably, it is present as 30 to 55 percent by weight. The second layer in a two-layer construction would not affect the percentage of the silver source material desired in the single imaging layer.

The silver halide may be any photosensitive silver halide such a silver bromide, silver iodide, silver chloride, silver bromoiodide, silver chlorobromoiodide, silver chlorobromide, etc., and may be added to the emulsion layer in any fashion which placed it in catalytic proximity to the silver source. The silver halide is generally present as 0.75 to 15 percent by weight to the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may be any material, preferably organic material, which sill reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

The toner system materials may be present, for example, in amounts of from 0.2 to 10 percent by weight of all silver-bearing components.

The binder may be selected from any of the well-known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The polyvinyl acetals, such as polyvinyl butyral and polyvinyl formal, and vinyl copolymers such as polyvinyl acetate/chloride are particularly desirable. The binders are generally used in a range of from 20 to 75 percent by weight of each layer, and preferably about 30 to 55 percent by weight.

For use on paper or other non-transparent backings it is found convenient to use silver half-soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about four or five percent of free behenic acid and analyzing about 25.2 percent silver, may be used. Other components, such for example as coloring, opacifiers, extenders, special sensitizing dyes, etc. may be incorporated as required for various specific purposes. Antifoggants, such as mercuric salts and tetrachlorophthalic anhydride, may also be included in the formulation.

These and other aspects of the present invention can be seen in the following examples. All proportions are by weight unless otherwise stated.

EXAMPLE 1

A photothermographic element was constructed comprising a support base of 4 mil ($1.02\times10^{-4}$m) polyethylene terephthalate filler base coated with a first layer comprising 12.5 parts silver behenate, 375 parts of polyvinyl butyral, 46 parts 1-methyl-2-pyrrolidone, 0.25 parts HBr and 0.10 parts HI, 0.20 parts HgBr,, 0.08 parts of a mercocyanine spectral sensitizing dye (Lith 454 dye disclosed in U.S. Pat. No. 4,260,677), 40 parts 1,1-bis(2-hydroxy-3,5-dimethylphenyl-2,5,5,-trimethylhexane and 10 parts of phthalazinone in a solvent solution of 6.5 parts methyl isobutyl ketone, 21 parts toluene and 60 parts methyl ethyl ketone. The solution was coated at 100 microns wet thickness and dried in a forced air draft at 85° C. for four minutes. A protective top coat of a polyvinyl acetate/polyvinyl chloride copolymer 80/20) in methyl ethyl ketone was coated at 65 microns wet thickness and similarly dried.

To the backside of the support base was coated a blend of two formulations:

| | |
|---|---|
| Formulation I | |
| Toluene | 68.35 |
| Methanol | 12.00 |
| Ethyl Cellulose (N-10) | 8.89 |
| Carbon Black (Cabot XC-72) | 3.43 |
| Graphite | 4.18 |
| Lecithin | 0.70 |
| Silicone dioxide | 2.45 |
| Formulation II | |
| Toluene | 72.93 |
| Methanol | 12.80 |
| Carbon Black (Cabot XC-72) | 6.51 |
| Ethyl Cellulose (T-10) | 7.76 |

The formulation to be coated comprised 50% by weight of each of these two blends. The dispersions were mixed and homogenized, coated at $2.5\times10^{-5}$m (wet thickness), and dried at 90° C. for three minutes.

The completed photothermographic element was exposed through a 0–4 step wedge to a xenon flash light source. A voltage of 535 volts was applied across the resistive layer for 4-5 seconds. Sufficient heat was generated to develop the silver image to a Dmax in excess of 2.0 and a Dmin of less than 0.20.

The resistive layer displayed a resistance ratio of about 2.8

EXAMPLES 2-5

The following formulations were combined with Formulation II (having the higher hydroxyl content ethyl cellulose, N-10, in place of the lower hydroxyl content T-10 ethyl cellulose) in 50/50 weight proportions as described in Example 1, then coated, dried, exposed and resistively developed as described in Example 1.

| | |
|---|---|
| Formulation III | |
| Toluene | 72.93 |
| Methanol | 12.80 |
| Carbon Black (Cabot XC-72) | 6.51 |
| Poly(vinyl butyral) | 7.76 |
| Formulation IV | |
| Toluene | 72.93 |
| Methanol | 12.80 |
| Carbon Black (Cabot XC-72) | 6.51 |
| Poly(acrylate) (Acryloid ® B-44) | 7.76 |
| Formulation V | |
| Toluene | 72.93 |
| Methanol | 12.80 |
| Carbon Black (Cabot XC-72) | 6.51 |
| Cellulose acetate | 7.76 |
| Formulation VI | |
| Toluene | 72.93 |
| Methanol | 12.80 |
| Carbon Black (Cabot XC-72) | 6.51 |
| Poly(vinyl acetate/vinyl chloride) copolymer | 7.76 |

Each of these blends of compositions could provide intermediate value resistance ratio layers. The poly(vinyl chloride/vinyl acetate) copolymers, cellulose acetate, and the poly(vinyl butyral) formed particularly compatible layers. Poly(vinylidene chloride) blends and polyurethane blends were satisfactory, but were rough to the touch.

What is claimed is:

1. A photothermographic element comprising a support base having on one surface thereof at least one photothermographically imageable layer and adhered to the opposite surface of said support a resistive layer having a resistance of between 60 and 2000 ohms per square and a resistance ratio of more than 1.05 and less than 3.00, wherein said resistive layer consists essentially of a blend of at least two polymers and a conductive filler, one of the polymers in said blend has a resistance ratio less than 1.50 and the other of said polymers has a resistance ratio of greater than 3.00, and wherein said polymer having a resistance ratio of less than 1.50 is selected from the group consisting of polyacrylate, poly(vinylidene chloride), poly(vinyl chloride), poly(vinyl butyral), poly(vinyl formal), poly(vinyl acetate), cellulose acetate, ethyl cellulose, polyurethane, cellulose acetate esters, and copolymers thereof and wherein said resistive layer has a thickness of $0.75\times10^{-5}$m and contains 30 to 60% by weight of said conductive filler.

2. The element of claim 1 wherein said filler comprises carbon black or graphite.

3. The element of claim 1 wherein said resistive layer comprises an ethyl cellulose polymer.

4. The element of claim 1 wherein said resistive layer comprises an ethyl cellulose polymer.

5. The element of claim 1 wherein said polymer having a resistance ratio of greater than 3.00 comprises ethyl cellulose.

6. A photothermographic element consisting essentially of a support base having on one surface thereof at least one photothermographically imageable layer and adhered to the opposite surface of said support a resistive layer having a resistance of between 60 and 2000 ohms per square and a resistance ratio of more than 1.05 and less than 3.00, wherein said resistive layer consists essentially of a blend of at least two polymers and a filler, one of the polymers in said blend has a resistance ratio less than 1.50 and the other of said polymers has a resistance ratio of greater than 3.00, and wherein said polymer having a resistance ratio of less than 1.50 is selected from the group consisting of polyacrylate, poly(vinylidene chloride), poly(vinyl chloride), poly(vinyl butyral), poly(vinyl formal), poly(vinyl acetate), cellulose acetate, ethyl cellulose, polyurethane, cellulose acetate esters, and copolymers thereof and wherein said resistive layer has a thickness of $0.75\times10^{-5}$m and contains 30 to 60% by weight of conductive filler.

7. The element of claim 6 wherein said filler consists essentially of carbon black or graphite.

8. The element of claim 6 wherein said resistive layer consists essentially of an ethyl cellulose polymer.

9. The element of claim 7 wherein said resistive layer consists essentially of an ethyl cellulose polymer.

10. The element of claim 6 wherein said polymer having a resistance ratio of greater than 3.00 consists essentially of ethyl cellulose.

11. The element of claim 6 having a protective layer over said photothermographically imageable layer.

12. The element of claim 7 having a protective layer over said photothermographically imageable layer.

13. The element of claim 8 having a protective layer over said photothermographically imageable layer.

14. The element of claim 10 having a protective layer over said photothermographically imageable layer.

* * * * *